US006383368B1

(12) United States Patent
Eaton

(10) Patent No.: US 6,383,368 B1
(45) **Date of Patent: *May 7, 2002**

(54) METHOD FOR PRETREATMENT OF REFINERY FEED FOR DESALTING THE FEEDSTOCK, AND RELATED ADDITIVE

(75) Inventor: Paul Eaton, Houston, TX (US)

(73) Assignee: Champion Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/613,713

(22) Filed: Jul. 11, 2000

Related U.S. Application Data

(63) Continuation-in-part of application No. 09/260,447, filed on Mar. 2, 1999, now Pat. No. 6,086,750.

(51) Int. Cl.[7] ..... C10G 17/00

(52) U.S. Cl. ..... 208/251 H; 210/106; 210/215; 210/737

(58) Field of Search ..... 205/251 R; 210/708, 210/725, 737

(56) References Cited

U.S. PATENT DOCUMENTS 4,007,109 A * 2/1977 Baird, Jr. et al. ..... 208/251 H
6,086,750 A * 7/2000 Eaton ..... 208/251 R

* cited by examiner

*Primary Examiner*—Helane Myers
(74) *Attorney, Agent, or Firm*—Browning Bushman P.C.

(57) ABSTRACT

A metal salt removal procedure for use with a crude oil flow is disclosed. A small amount of water, and a caustic in the range of 7–12 pH, and preferably 9–12 pH, are injected to form water bubbles surrounded by oil. An ethylene oxide reacted with polypropylene glycol at 350° F. or so yields a water soluble demulsifier added at the rate of a few ppm to the water in oil mix. The added reaction product, a polyol, enables metal salt isolation in the water.

5 Claims, 2 Drawing Sheets

METHOD FOR PRETREATMENT OF REFINERY FEED FOR DESALTING THE FEEDSTOCK, AND RELATED ADDITIVE

This is a Continuation in Part of U.S. patent application Ser. No. 09/260,447, filed Mar. 2, 1999, now U.S. Pat. No. 6,086,750.

FIELD OF THE INVENTION

The present invention relates generally to the field of oil refining and more particularly to a method of pre-treating refinery stock and additives related to that method.

BACKGROUND OF THE DISCLOSURE

Assume that a gathering line from an oil field delivers a flow of crude oil to a refinery. Prior to treatment in the refinery, including distillation into the various fractions of commercial importance, it is necessary to evaluate the feedstock for metal salts and similar contaminants in the feedstock. If left unchecked, the metal salts typically will accelerate corrosion of the process vessels. With the customary increases in temperature, the metal salts will generate acids which react with the metal surfaces in the process equipment, thereby severely corroding the surfaces of the process equipment, leading to early equipment failure. This mechanism is discussed below. The present disclosure is directed to a reduction in the metal salts. The problem is materially aggravated for crude stocks which have an API gravity of 25 or less. Especially, a crude stock which has an API gravity of about 20 to 25 poses a significant problem. The problem derives in part from the difficulties of separating oil and water where the feed has that range of gravity. Effectively, this relates to the lack of density differences between water and oil.

To provide a bit of background, there are three major metal salts which may be recovered from a producing formation. While they may be in trace quantities, even as few as a few parts per million (ppm hereafter) in the feed will pose a problem. This is especially true of sodium, calcium, and magnesium making up the salts in the flowing feedstock. The presence of some quantity of water may give rise to a water/oil segregation which can in some instances take the metal salts out of the oil. By suitable pretreatment steps, the salt in the oil can be reduced. However, this is more difficult when the oil is very close in density to water. In the past, simply inputting the feed into a large storage tank (or tank farm comprised of many tanks) and waiting for a long interval would tend to drop the water to the bottom. As the water and oil densities become close, there is less likelihood of settling out the water and any water soluble salts that are in it. Therefore, there is a serious problem in removing the salts in crude feedstocks having an API gravity of about 20 to 25.

It is sometimes helpful to add a trace of water, the amount to be discussed, to the flowing crude oil so that the salts can go into solution in the water. The water added will form stable water droplets in the oil. By adding a demulsifier and through the use of high voltage contacts forming an electric field, sometimes the water droplets can be collected and segregated taking advantage of the electric field stress across the flow. This ultimately segregates the water which is then the preferential solvent for the salts and this enables removal of some, perhaps most of the salts in the flow. It is cooperative with a typical wash water added to the heated oil momentarily which comprises about 4% to 8% of the flowing oil volume with a view of removing somewhere between 20% to about 80% of the salt in the crude oil. Interestingly, with high gravity oil, more of the salts can be gotten out because more of the water is taken out, working with a greater density difference between oil and water. If, however, the crude oil has an API gravity of about 20 to 25, removal is degraded, even to as little as 20% of the salt. Leaving 80% of the salt in the crude oil is highly undesirable.

The present disclosure is directed to a method and apparatus for handling that kind of crude and effectively removing far more than just 20% of the salt. Targeting a removal rate of 95% or more of the salts, the present disclosure sets forth a method of pretreatment for the refinery feedstock which assists remarkably in salt removal. It does this by changing the surface tension between the water droplets in the oil, thereby enabling agglomeration of the water. Moreover, the water more readily disperses in the crude. Effectively, the water is more easily collected, thereby converting it more readily from the droplets dispersed through the oil stream. On the one hand, the droplets are highly desirable, thereby yielding a larger oil/water interface for surface contact to thereby preferentially dissolve the metal salts, and yet afterwards, the water is more easily removed thereby taking more of the metal salts with the water. Effectively, the process of the present disclosure overcomes the propensity of metal salts to stay in suspension in the crude oil. They are brought preferentially into the salt water, removed, thereby protecting the downstream equipment from corrosion.

One aspect of the present invention is the injection of a pretreatment mix of water and a special ethoxylated polyol demulsifier with water. The water is added in the range of up to an effective amount being about 1% of the total crude flow. The polyol added is typically in the range of about 5 or 10 ppm; the amount can be increased or decreased dependent on the severity of the problem and the relative API gravity of that particular crude feedstock. As the gravity increases, the amount or the degree of need for the present polyol demulsifier addition is reduced. The method of application will be set forth in detail below. It will be given in the context of an operating crude oil processing unit typically incorporating a distillation column for breaking down the crude into the various cuts or subsequent use. Further, the context will provide a method of use and will also provide a method of manufacture of the ethoxylated polyol for the present disclosure.

Since the filing of my U.S. patent application Ser. No. 09/260,447 filed Mar. 2, 1999 now U.S. Pat. No. 6,086,750. I have also discovered that the addition of caustic to process provides three additional benefits: (1) the caustic help to water-wet the solid crystalline salts or inorganic materials; (2) the caustic also forms metal hydroxides with other contaminants in the oil, making them more water soluble and thus more easily removed from the oil; and (3) the caustic greater enhances the breakout of water from the oil. I have found that caustic in the pH range of 7–12, and preferably in the pH range of 9–12, in addition to the water and other additives of my method, provide significant enhancement of the benefits of my method.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawing.

It is to be noted, however, that the appended drawing illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
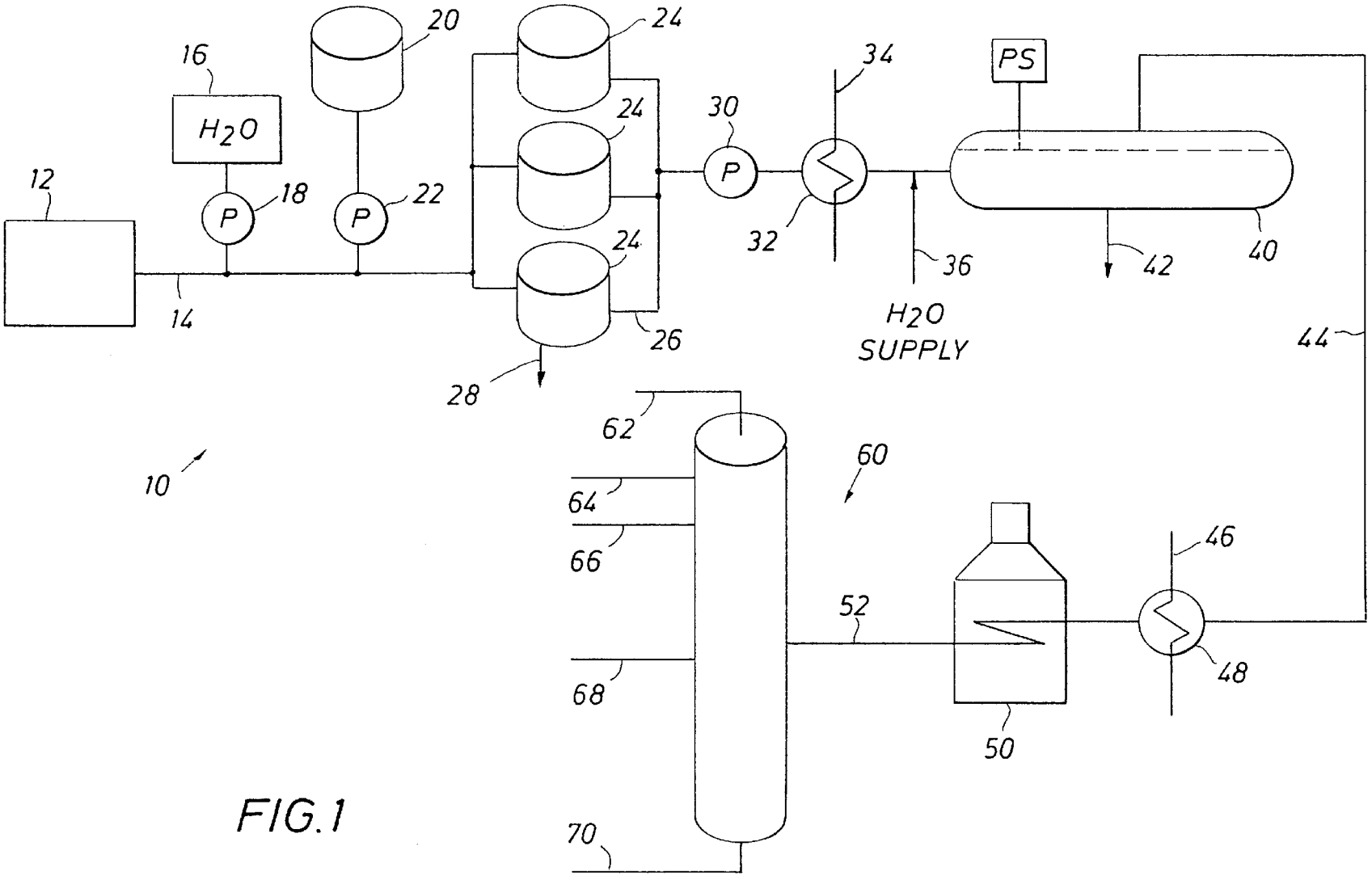
FIG. 1 illustrates a crude oil distillation system equipped with a pretreatment apparatus and capable of adding the pretreatment materials to enable salt and water removal to thereby reduce the amount of metal salts input to the high temperature crude processing unit.

A crude processing system is set forth in the attached view. Beginning at the far left, the system 10 includes as set of gathering lines 12 which connect to the well heads of one or many producing wells. The gathering lines 12 then connect with an oil pipeline 14. It is of sufficient length to deliver the untreated crude oil production. The numeral 16 identifies a water tank which connects with the pump 18 which adds water to the pipeline in an amount to be discussed. The tank 20 is a supply of an ethoxylated polyol demulsifier. The tank 20 delivers that through a pump 22 into the line for reasons and purposes to be described.

The crude delivery line is input to a tank farm. A crude oil storage tank 24 is provided with the flow. The size of the tank 24 is a matter of scaling to a desired size. The tank is sized so that the crude with a trace of water added from the water supply 16 is introduced. This is a pretreatment step which is important to the processing to the crude oil downstream. Considering now, however, the tank farm, the tank 24 is one of several tanks. In a typical situation, the tanks are relatively large so that the crude is held for an interval of hours. Assume that the flow of the pipeline 14 is sufficient to fill the tank in 12 hours. By using three tanks, the first tank can be filled in 12 hours and then is permitted to sit for 24 hours without disturbance. During that 24 hour interval, the second tank is then filled and then the third tank is filled, and then the pipeline 14 is reconnected to the first tank. The tanks are filled and are permitted to sit for an interval of about 24 hours. This works nicely with tanks which are approximately equal in size. In all instances, the feedline is connected to the tanks at some midpoint on the tank. Assume that the height of each tanks is equal and arbitrarily set that height at 20 feet. The feedline will introduce the oil at a height anywhere from about two feet to perhaps ten feet above the bottom of the tank. The tanks are filled by the pipeline 14. They are drained through individual outlet lines 26 from each of the tanks. These outlet lines are connected above the bottom. They are typically connected above the bottom at a height of about one to three feet above the bottom of the tanks. The tanks are equipped with a bottom and the bottom ideally tapers to a centralized bottom or sump. A water drain line 28 is illustrated for one of the tanks, but it will be understood that it is replicated for all the tanks. The tanks thus funnel the accumulated heavier materials (water primarily) at the bottom and they are drained in a controllable fashion so that the primary discharge is salt water for reasons to be explained.

Continuing with the equipment, the tanks connect through a pump 30 which then is input to a heat exchanger 32. A heated fluid is provided through the line 34 and delivers heat in the heat exchanger. This raises the temperature in a manner to be described. A water supply line 36 is connected to the flow of heated crude oil and is delivered with the crude into a horizontal desalter tank 40. The desalter tank encloses an electrified grid connected to a power supply to impress an electric field across the heated emulsion. The tank 40 has a discharge line 42 at the bottom. This delivers out of the tank any salt water that is recovered in the desalter. More will be noted concerning that operation. The desalter is connected to an outlet line 44 where the desalted crude flows out of the tank. The line 42 is connected from the very bottom of the tank 40 to assure that the heavier materials are removed at the bottom. They are removed from the system and are not further processed.

The line 44 then connects with another heat exchanger which is provided with a heated fluid input through the line 46. The heat exchanger 48 raises the temperature to a greater level. The next stage is heating in a furnace 50. Representative temperature levels for that will be given below. The last stage of the equipment is input of the heated crude into a distillation column or tower 60. This is delivered through a feedline 52 serially continuing from the heat exchanger 48. The feedline 52 is input at a midpoint on a distillation column or tower 60. Gases or vapors are removed from the top by a top fractional cut line 62. Very light gasoline is removed on the line 64 while heavier gasoline is delivered on the line 66. The line 68 is a typical diesel cut obtained from the distillation column. The bottoms from the column are removed by the line 70. The lines 62 through 70 are tapped from the distillation column at heights which are selected to control the discharge from the column. Generally, the column has a multitude of trays in it with an internal reflux flow moving from tray to tray. Vapors rise while liquids fall. The process is continued in a feedback mode so that the distillation tower provides the appropriately selected molecular cuts of the feed. Generally, each fractional cut is directed to a different market, primarily because it has different values and different heat content.

In general terms, the heat exchanger 32 in conjunction with the heat exchanger 48 raises the temperature of the crude to about 500 to about 550° F. The furnace 50 raises the temperature of the crude to about 600 up to about 650° F. It assures that the temperature is appropriate for operation of the distillation column. With all of the components heated to the representative temperatures given, metal salts are much more chemically active and initiate acid formation which reacts with the steel surfaces to create corrosive damage.

Figure 2:
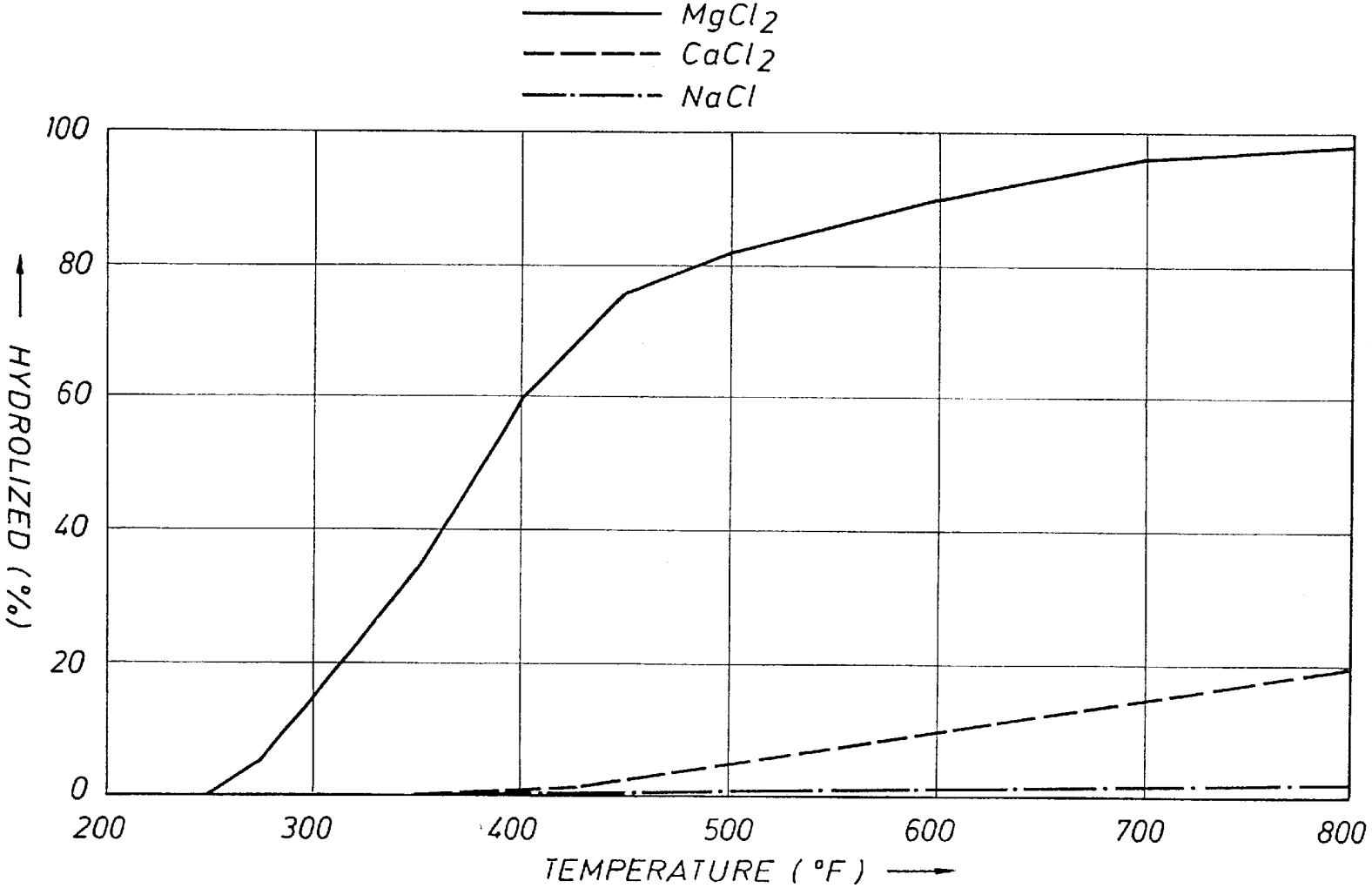
FIG. 2 shows a graph of metal salt activity as a function of temperature.

FIG. 2 of the drawings is a curve of metal salt hydrolysis as a fiction of temperature. It includes three curves which relate to the most common metal salts encountered in produced crude oil. They are typically chlorides, and are commonly sodium, calcium, and magnesium. While the relative proportions may differ, it is not significantly important that sodium is present. FIG. 2 explains why this is so. By contrast, even though magnesium is less plentiful in most situations, the magnesium chloride provides the greatest problem. As explained earlier, the temperature is in the range of 600° F. or 650° F. going into the distillation column. At that temperature level, very little of the sodium and calcium salts is converted. By contrast, practically all of the magnesium chloride is converted. Ultimately, this creates a significant conversion of HCI acid in the oil and that will create far greater damage than the damage resulting from the other two salts. FIG. 2 therefore illustrates how the high percent is hydrolyzed at the prevailing temperatures in this process and thereby creates a lot of damage resulting from the magnesium salt. Even upstream of the furnace 50, this is something of a problem at the other equipment, but the conversion of the other two salts is substantially nil.

The present disclosure is directed to reducing corrosion. It works in conjunction with the desalter 40 previously mentioned. The water supply 36 normally delivers wash water in the amount of about 4% to about 8%. That is added to the flow and is therefor proportional to the flow. It is then removed in the desalter tank 40. Stratification is normally accomplished at that stage to thereby enable the water that is added to now be removed. In the optimum circumstance, a short dwell time is all that is needed. In ordinary operation, the water is simply added and mixed with the oil, and then is removed by the salt water removal line 42 along with the salts, and this is especially true with metal salts which are more readily water soluble. The present disclosure contemplates the pretreatment addition of water from the water source 16 at a rate which is sufficient for the present system. This tends to be in the range of about one quarter, but perhaps even better at one half percent up to about one percent of the total crude flow. The water flow is preferably metered into the crude flow in the line 14 so that the water flow tracks or follows the rate of crude oil pumped through the line 14. Accordingly, by adding this much water, and then adding the ethoxylated polyol demulsifier from the supply 20, the pretreatment significantly reduces the amount of metal salts delivered into the system.

In addition to the water metered into the line 14, the tank 16 may also include a caustic. As used herein, the term "caustic" specifically refers to hydroxyl ion contributors, such as for example but not limited to magnesium, ammonium, calcium, sodium, and potassium hydroxide. I have found that injecting the caustic at about 7–12 pH, and preferably at about 9–12 pH, significantly enhances the water-wetting of the salts, forms metal hydroxides with metal contaminants so that they are easily removed from the oil, helps to break out the water from the oil once its job is done. The caustic is injected, in addition to the demulsifier.

The demulsifier of the present invention is added at rate of up to twenty ppm, but it appears normally that crude oil having an API gravity of about 22 to about 23 can be treated with about five to ten ppm of the additive. This is effectively added immediately adjacent to the water injection so it can be treated in part as an injectable along with the water if desired. They are shown as separate sources with separate pumps in the system illustrated so that separate control can be asserted over the two additives namely, the trace of water and the ethoxylated polyol demulsifier. These two additives, hence, a single additive in a real sense, are mixed into the flowing oil which is permitted to settle. A large portion of the salts are taken out of the storage tanks 24. They are removed by collecting the sediment in the tanks. Sometimes, the sediment is known as BSW which refers to the water and any other particulate trash, emulsified water droplets, and so on. All of these are collected and delivered through the bottom drains in the tanks. Thereafter, the temperature of the feed is raised to an intermediate temperature. An intermediate temperature is somewhere between about 150iF and about 300iF. With the temperature raised by the heat exchanger 32, settlement time in the tank 40 is markedly changed. With ambient temperatures prevailing on the tank 24, it takes hours to accomplish settlement or stratification. Indeed, many droplets will simply not settle without a long time interval, but the intervals cannot be readily accommodated with lower gravity crude oil feedstocks. The elevated temperature accomplished with the desalting tank 40 speeds up segregation. It speeds up the recovery of water at the bottom along with the water soluble salts in it. This then enables removal from the bottom drain line 42. It also encourages and assists in water removal with the metal salts. Some representative examples should be considered. The salts that do the most damage are salts of sodium, calcium and magnesium. It is possible that other salts will be mixed with it. For these reasons, there is a greater risk of problem with magnesium compared to other metal salts.

Consider as an example a system using the ethoxylated polyol of the present disclosure. For example, working with Mayan crude having an API gravity reading of about 22 to about 23, the amount of water added from the water supply 16 was adjusted to something in the range of one half to one percent of the crude flow. The ethoxylated polyol was added at the rate of about ten ppm. A settlement interval of 24 hours for each of the tanks 24 was sufficient. The heat exchanger 32 raised the oil temperature from prevailing outdoor ambient temperature to something in excess of 200iF. The water supply line 36 added water at the rate of not more than 8%, typically in the range of about 4% to 5%, and that water was removed from the desalter tank at elevated temperature. At this juncture, two "cuts" had been taken from the salt content in the system. It was deemed relatively successful by the removal of the metal salts in two stages just noted. Considering the example further, the feed ultimately delivered to the distillation column provided at a temperature of about 600iF, and routinely operated at about 625iF.

The ethoxylated polyol of the present disclosure is obtained by using a starting material of polypropylene glycol having a molecular weight in the range of about 3,500 to 4,500. That is initially reacted at about 300iF to about 350iF in an appropriate container for an adequate interval with ethylene oxide heated to a temperature as noted at about 300iF to 350iF. It is appropriate to add about 15 to 20 moles of ethylene oxide for each mole of the polypropylene glycol. The preferred oxide is the C2 molecule because C3 or C4 is too oil-like and will not act readily at the water/oil interface. Therefore C2 is preferred.

While the foregoing is directed to preferred embodiment, the scope thereof is determined by the claims which follow.

What is claimed is:

1. A method of pretreatment of a flowing crude stream for removal of metal salts comprising the steps of:

(a) directing a flow of produced crude oil along a pipeline and having an API gravity in the range of about 20 to 25;

(b) injecting an effective amount of water into the flowing crude to dissolve said metal salts prior to desalting;

(c) injecting an effective amount of caustic with the water to help water wet the metal salts;

(d) adding a polyol demulsifier in an effective amount to the flowing crude to enable agglomeration of said water; and (e) settling the crude in a tank to enable the water to settle to the bottom thereof with metal salts from the crude in the water.

2. The method of claim 1 wherein caustic is injected in the range of 7–12 pH.

3. The method of claim 1 wherein caustic is injected in the range of 9–12 pH.

4. The method of claim 1 including the step of adding the caustic and the polyol in an amount sufficient to demulsify the water and crude to thereby enable the water and crude to stratify, and transfer the metal salts from the crude into the water for removal with the water.

5. The method of claim 1, further comprising the step of adding water and caustic so that droplets of water in the oil are formed, and adding the demulsifier therewith, and then directing the flow of the pipeline into a tank subject to isolation so that the tank permits settling over time to break the emulsion of the oil in the water.

* * * * *